United States Patent [19]

Lambertson

[11] 4,203,379

[45] May 20, 1980

[54] METAL TUB MADE FROM FLAT METAL SHEETS

[76] Inventor: Theodore C. Lambertson, 2 Lombardi, Millbrae, Calif. 94030

[21] Appl. No.: 928,354

[22] Filed: Jul. 27, 1978

[51] Int. Cl.[2] ..... B21D 51/18

[52] U.S. Cl. ..... 113/120 B; 113/120 C; 72/389

[58] Field of Search ..... 113/120 R, 120 B, 120 C, 113/120 E, 120 G, 1 N, 1 M, 116 W, 120 HA; 72/306, 319, 321, 323, 389

[56] References Cited

U.S. PATENT DOCUMENTS

| | | | |
|---|---|---|---|
| 1,974,794 | 9/1934 | Blickman | 113/120 B |
| 3,127,862 | 4/1964 | Presnick | 113/120 E |
| 3,994,152 | 11/1976 | Wolters | 72/319 |

*Primary Examiner*—Michael J. Keenan
*Attorney, Agent, or Firm*—Donald C. Feix

[57] ABSTRACT

A stainless steel tub is made from sheet metal panels which are pressed to position and then welded instead of being drawn from a metal blank. The tub is made from a flat metal sheet having a bottom panel and four side panels with each side panel attached along one edge of the bottom panel. The side panels are pressed from the flat position to an upright position with respect to the bottom panel, and the pressing steps are performed with a press having an upper die constructed with a slot which receives and permits movement of one upright side panel within the slot during the time that a second adjacent side panel is being pressed upright for subsequent connection to the first panel. The press also is constructed to produce a curve in a side margin of the second side panel simultaneously with and as part of the step which pressed the first side panel to the upright position. The upper die of the press is shaped to produce a smoothly curved transition between the bottom panel and each side panel, and V shaped notches are formed at locations in the flat sheet to permit these inner curved surfaces between the side panels and the bottom panel to meet in a compoundly curved surface without buckling and without any substantial gap in the corner formed between adjacent side panels and the bottom panel.

7 Claims, 6 Drawing Figures

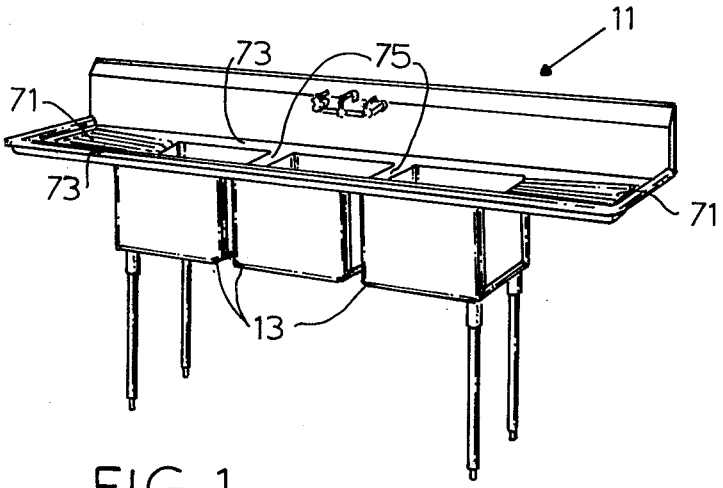
FIG. 1
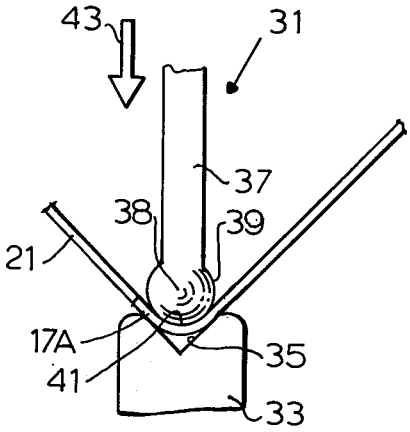
FIG. 3
FIG. 2
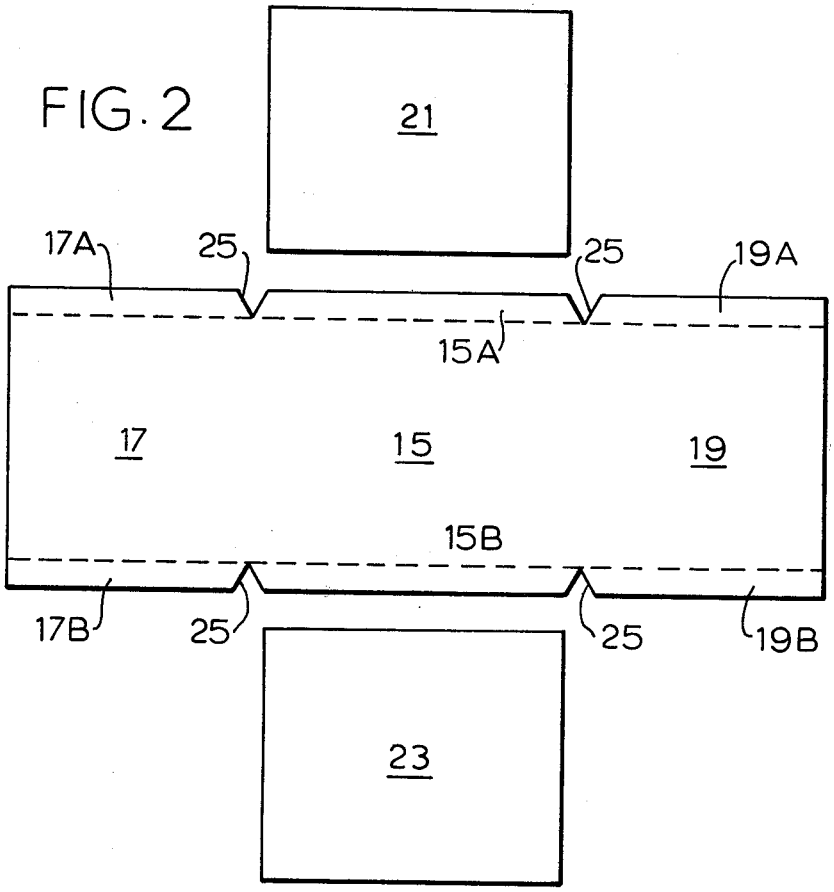

FIG. 4
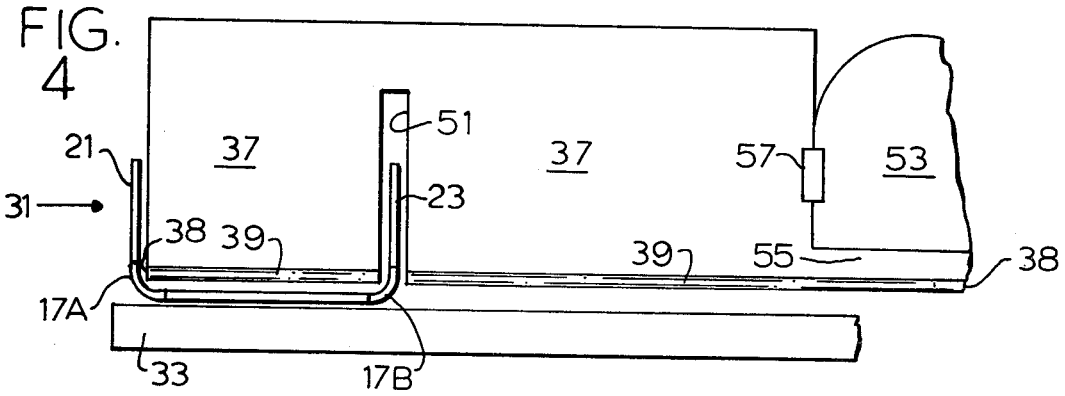
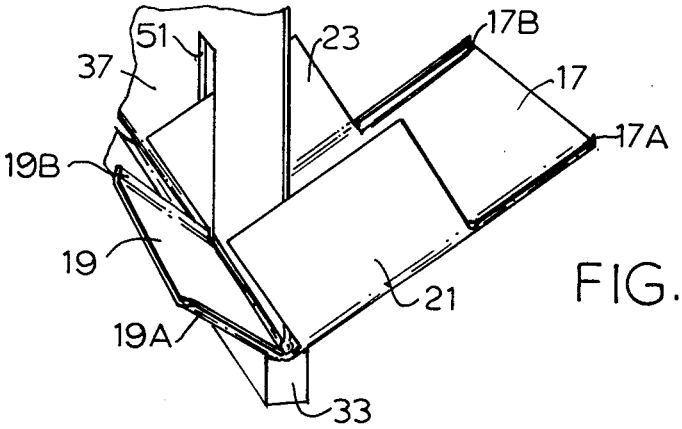
FIG. 5
FIG. 6
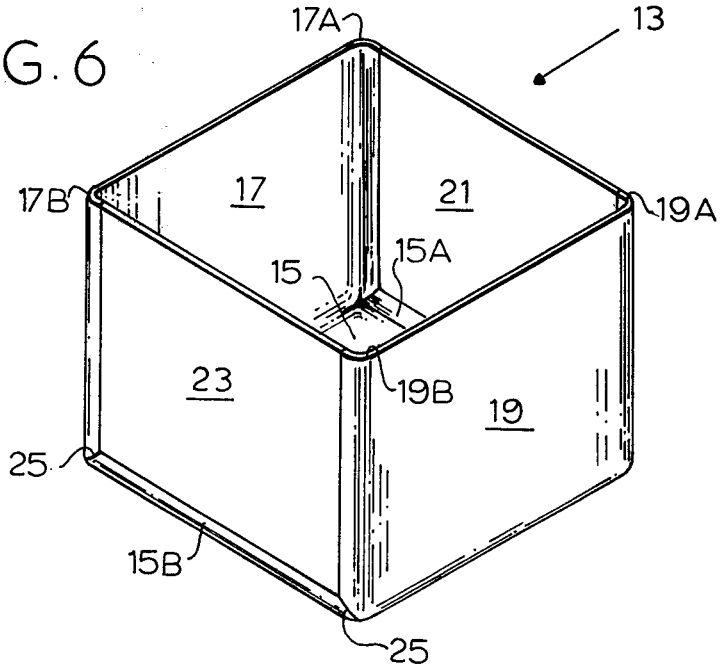

METAL TUB MADE FROM FLAT METAL SHEETS

BACKGROUND OF THE INVENTION

This invention relates to metal tubs. It relates specifically to a method of making a metal tub from flat metal sheet by pressing and welding steps.

The tub made by the present invention has particular application for use as a stainless steel tub in bar sinks, kitchen sinks and the like.

A stainless steel tub of this kind should have a smooth interior surface which is free of cracks and crevices which could collect dirt or other debris. The transitions between the sides and the bottom should therefore be smoothly curved without sharp angles or corners.

To obtain this kind of smooth inner sink surface most stainless steel tubs have been formed by a drawing operation. The drawing operation requires large and expensive equipment capable of producing very substantial forces in order to draw the sides of the stainless steel to the required height.

Also, the drawing operation is apt to leave the bottom relatively thin; and this can cause problems, especially around the drain hole.

It is a primary object of the present invention to make a stainless steel tub that has the desired inner surface configuration and to do this by pressing and welding operations which do not require drawing.

It is a related object of the present invention to make the metal tub from flat metal sheet stock and to thereby produce a sheet metal tub that is both stronger and less expensive than the prior art drawn metal tubs.

It is another important object of the present invention to substantially eliminate the waste or scrap by using a procedure which produces little scrap metal.

SUMMARY OF THE INVENTION

The method of the present invention starts with a flat metal sheet comprising a bottom panel and a first pair of side panels. This sheet is formed with four V shaped notches so that there is a notch at each end of each side panel at the juncture of the side panel with the bottom panel.

A second pair of side panels is then welded to the bottom panel while all five bottom and side panels are in the flat.

The next step is to press the second pair of welded on side panels to an upright position with respect to the bottom panel. This pressing operating is performed by a press with an upper die component having a lower edge which is generally circular in cross section and which is long enough to press not only the length of the side panels but also the side margins of each of the first pair of side panels which extend outwardly from the notches noted above. The curved surface of the upper die produces a smooth transition between the bottom panel and the side panel which has been pressed upright, and this curved surface of the upper die also produces the same curvature in each of the side margins of the second pair of side panels so that there will be a smoothly curved transition from one side panel to an adjacent side panel in a completed tub.

The second side panel in the first pair of side panels is then pressed upright, and the related side margins of the second pair of side panels are simultaneously curved as described above.

The next steps are to press the two remaining side panels of the second pair of side panels to an upright position with respect to the bottom panel. This is accomplished by a press having an upper die constructed with a slot which receives and permits movement of a first side panel within the slot during the time that a side panel in the second pair is being pressed upright.

The angle within the notch and the curvature produced by the upper die are so related that the notch permits the inner curved surfaces formed between the side panels and the bottom panel to meet in a compoundly curved surface without buckling and without any substantial gap in the corner formed between two adjacent side panels and the bottom panel.

At the conclusion of the pressing operations, the aligned edges of the adjacent side panels are welded together. This welding is performed from the outside of the tub to minimize the grinding and the polishing the weld of the inside of the tub.

In those cases where the tub is incorporated in a bar sink, the frame for the bar sink itself is preferably formed by welding sheet metal strips together, and the tub is then suspended within the frame by welding the top edges of the tub to the frame.

The upper die, in one embodiment of the present invention, is an extension which is attached to a standard press brake and is constructed so that a number of different dies can be readily attached to or removed from the standard press brake to make tubs of different sizes.

Tub forming methods and apparatus which incorporate the structure and techniques described above and which are effective to function as described above constitute further, specific objects of this invention.

Other and further objects of the present invention will be apparent from the following description and claims and are illustrated in accompanying drawings which, by way of illustration, show preferred embodiments of the present invention and the principles thereof and what are not considered to be the best modes contemplated for applying these principles. Other embodiments of the invention embodying the same or equivalent principles may be used, and structural changes may be made as desired by those skilled in the art without departing from the present invention and the purview of the appended claims.

BRIEF DESCRIPTION OF THE DRAWINGS

FIG. 1 is an isometric view of a bar sink embodying stainless steel tubs constructed in accordance with one embodiment of the present invention.

FIG. 2 is a top plan view showing the flat metal sheets used to make the tub of the present invention.

FIG. 3 is an end elevation view showing how the first side panel is pressed upright with respect to the bottom panel while being formed with a smooth transition surface between the lower part of the side panel and the bottom panel. This figure also shows how related side margins of the second pair of side panels are formed with a curved inner surface simultaneously with the pressing of the first side panel.

FIG. 4 is a front elevation view of the press structure shown in side elevation in FIG. 3. FIG. 4 shows how a side panel which has previously been pressed upright fits within a slot in the upper die at the time that an adjacent panel is being pressed from the flat position to the upright position with respect to the bottom panel.

FIG. 5 is a perspective view showing a side panel being pressed upright and into edge alignment with two adjacent side panels which have previously been pressed upright.

FIG. 6 is a perspective view showing all four side panels of the tub pressed upright and ready for welding together along their aligned edges.

DESCRIPTION OF THE PREFERRED EMBODIMENTS

In FIG. 1 a bar sink is indicated generally by the reference numeral 11. The bar sink is a stainless steel bar sink and incorporates three tubs 13 constructed in accordance with one embodiment of the present invention.

Each tub 13 is made from flat metal sheet; and, as best illustrated in FIG. 2, comprises a bottom panel 15, a first pair of side panels 17 and 19, and a second pair of side panels 21 and 23.

As also illustrated in FIG. 2 a V shaped notch 25 is located at each corner of the bottom panel 15; (and as will be described in more detail below) these notches 25 coact with the radius of curvature of a curved transition surface extending between each of the side panels and the bottom panel to permit smoothly shaped, compoundly curved corners to be formed in the tub without buckling or creasing.

The side panels 21 and 23 are initially separate from the sheet containing the bottom panel 15 and the side panels 17 and 19, and the side panels 21 and 23 are welded to the related edges of the bottom panel 15. This helps to eliminate scrap which could otherwise be formed if the five panels were cut from a larger sheet.

The side panels 21 and 23 are welded to the bottom panel 15 while all of the metal sheets are in the flat, and the grinding and polishing of the welds are also performed in the flat to thereby permit easy welds and easy grinding and polishing of these welds.

The next step is to press the side panels 21 and 23 to an upright position with respect to the bottom panel 15. This is done by a press 31 as illustrated in FIG. 3.

The press 31 comprises a lower die 33 having a V shaped surface 35 and an upper die 37 having a lower end 38 which has an outer surface 39 shaped to produce a smoothly curved inner surface 41 between the bottom panel 15 and each side panel. As shown in FIG. 3 the surface 39 is generally circular in cross section.

As the upper die 37 moves downward, in the direction indicated by the block arrow 43, it engages the flat sheet and presses the side panel 21 to the upright position as illustrated.

Furthermore, since the lower end 38 of the upper die extends along the entire length of the combined panels 17, 15 and 19 (as viewed in FIG. 2) the curved surface 39 also presses the side margins 17A, 15A and 19A (see FIG. 2) of the respective side panel 17, bottom panel 15 and side panel 19 to the same curvature 41.

In the next step the other side panel 23 of the first pair of side panels 21 and 23 is pressed upright (as described above with respect to the side panel 21), and the side margins 17B, 15B and 19B (see FIG. 2) are simultaneously formed with the curvature 41.

After the first pair of side panels 21 and 23 have been pressed upright, the second pair of side panels 17 and 19 are pressed upright. This pressing operation is illustrated in FIGS. 4 and 5. In FIG. 4 the partially formed tub has been repositioned in the press 31 with the side panel 19 aligned beneath the upper die 37, and FIG. 5 shows the upper die 37 moved downward in the course of pressing of the panel 19 to its upright position.

As illustrated in FIGS. 4 and 5, the upper die 37 is constructed with a slot 51 which receives and permits movement of the side panel 23 within the slot during this pressing step.

Also, the length from the outer end of the die 37 to the slot 51 is related to the length of the side panel 19 between the notches 25 so as to provide the smoothly curved inner surface 41 continuously along the line between the notches 25.

The next step is to press the remaining side panel 17 to the upright position to complete the pressing of the tub 13 to the configuration shown in FIG. 6.

At this point, the related side edges of the side panels are ready for welding together. These welds are bead welds which are preferably performed after all of the side edges have been tacked together by spot welds.

All welds are preferably made from the outside of the tub to minimize the grinding and polishing of the inside surfaces of the tub.

As best illustrated in FIG. 6, the notch 25 permits the curved surfaces between adjacent side panels and bottom panel to meet in a compoundly (triple) curved surface at each corner without buckling and without any substantial gap in the corner areas.

The curved side margins 17A, 17B, 19A and 19B also provide smoothly curved transitions between the side panels.

As also viewed in FIG. 6, the welded connection between each side panel has a straight edge portion 26 and an angled edge portion 25 extending through the compoundly curved surface of the corner. This configuration, in combination with the curvatures formed by the press 31, produces a stainless steel tub having an entire inner surface which is either a flat surface or a smoothly curved surface without any sharp angles or creases.

The upper die 37 is preferably constructed as a removable extension for the usual upper part 53 of the press brake. As illustrated in FIG. 4 the upper die 37 comprises an arm 55 which fits beneath the part 53 of the press brake, and a coupling 57 which permits the slotted die 37 to be connected to or removed from the part 53. Different size dies 37 can therefore easily be installed for use with different size tubs.

Referring again to FIG. 1, the bar sink 11 comprises a top frame made up of steel strips. Thus, the bar sink 11 comprises a top frame having plate sections 71, longitudinal strips 73 and cross strips 75 which are welded together to form the top frame. The top edges of each tub 13 are then welded to the top frame to suspend the tubs 13 from the top frame.

The other parts of the bar sink 11 are also made of flat sheet metal stock pressed to shape and welded in position to minimize cost.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. In a method of making a metal tub from a flat metal sheet having a bottom panel and four side panels with each side panel attached along one edge to the bottom panel, said method comprising, pressing a first side panel from the flat position to an upright position with respect to the bottom panel, pressing a second side panel which is immediately adjacent to the first side panel from the flat position to an upright position with respect to the bottom panel, performing the second pressing step with a press having the same upper die for the second pressing step as used for the first pressing step, said upper die having a slot which receives and permits movement of the first upright side panel within the slot during the second pressing step, and connecting the adjacent edges of the upright side panels.

2. The invention defined in claim 1 including forming a smoothly curved inner surface between the bottom panel and the side panel in the course of the pressing step by engaging the inner surface with an upper die having a lower edge which is generally circular in cross section.

3. The invention defined in claim 2 including forming a V shaped notch in the flat metal sheet at each end of the second side panel, pressing the side margin part of the second side panel which extends outwardly from the notch to a curved configuration having the same curvature as the curved inner surface formed between the first panel and the bottom panel, and doing the side margin pressing step simultaneously with and as part of the step which presses the first side panel to the upright position, and wherein the angle within the notch and the curvature of the curved surfaces are so related that the notch permits the inner curved surfaces formed between two adjacent side panels and the bottom panel to meet in a compoundly curved surface without buckling and without any substantial gap in the corner formed when the second side panel is pressed to the upright position.

4. The invention defined in claim 3 wherein the upper die has a length from the outer end of the die to the slot which is related to the length of the second side panel between the notches so as to provide the smoothly curved inner surface continuously along the line between the notches.

5. The invention defined in claim 1 including pressing all four side panels to the upright positions and welding the adjacent edges of the side panels together after all of the side panels have been pressed to the upright positions.

6. The invention defined in claim 5 including grinding and polishing the welds.

7. A method of making from flat sheet metal panels a tub having smoothly curved surfaces between the bottom and all four sides and comprising, forming four V shaped notches in a first metal sheet to define a bottom panel and a first pair of side panels attached to opposite edges of the bottom panel with a pair of the V shaped notches at each end of each side panel at the juncture of the side panel with the bottom panel, welding each of a second pair of side panels to related opposite edges of the bottom panel while all five of the bottom and side panels are in the flat, pressing each panel of one pair of the side panels to an upright position with respect to the bottom panel, pressing each panel of the other pair of side panels to an upright position with respect to the bottom panel, performing all of the pressing steps with the same upper die, said upper die having a lower edge which is shaped to produce a smoothly curved transition from the bottom panel to each side panel and to permit the edges of each notch to meet in a compoundly curved surface without buckling and without any substantial gap in the corner formed between two adjacent, upright side panels and the bottom panel, welding together the adjacent edges of each of the side panels after all of the side panels have been pressed upright, and wherein the upper die has a slot which, during the pressing upright of the last to be formed pair of side panels, receives within the slot an adjacent side panel that has been previously pressed upright.

* * * * *